United States Patent [19]

Misawa et al.

[11] Patent Number: 4,570,115

[45] Date of Patent: Feb. 11, 1986

[54] VOLTAGE REGULATOR FOR LIQUID CRYSTAL DISPLAY

[75] Inventors: Toshiyuki Misawa; Tatsushi Asakawa, both of Suwa, Japan

[73] Assignee: Kabushiki Kaisha Suwa Seikosha, Tokyo, Japan

[21] Appl. No.: 659,973

[22] Filed: Oct. 12, 1984

Related U.S. Application Data

[63] Continuation of Ser. No. 217,500, Dec. 17, 1980, abandoned.

[30] Foreign Application Priority Data

| | | | |
|---|---|---|---|
| Dec. 19, 1979 | [JP] | Japan | 54-165270 |
| Dec. 24, 1979 | [JP] | Japan | 54-168499 |
| Dec. 28, 1979 | [JP] | Japan | 54-171806 |
| Apr. 7, 1980 | [JP] | Japan | 55-45468 |

[51] Int. Cl.[4] ..... G05F 3/20

[52] U.S. Cl. ..... 323/313; 323/907; 323/354; 340/813

[58] Field of Search ..... 307/296 R, 297; 323/226, 229, 280, 281, 312, 313, 315, 352, 354, 907; 340/636, 812, 813, 765; 368/204; 350/332

[56] References Cited

U.S. PATENT DOCUMENTS

| | | | |
|---|---|---|---|
| 4,045,791 | 8/1977 | Fukai et al. | 340/813 X |
| 4,088,941 | 5/1978 | Wheatley | 323/313 X |
| 4,099,115 | 7/1978 | Watanabe | 323/907 X |
| 4,217,535 | 8/1980 | Suzuki et al. | 340/636 X |
| 4,242,679 | 12/1980 | Morozumi et al. | 340/813 X |
| 4,258,310 | 3/1981 | Asakawa et al. | 323/354 X |
| 4,297,697 | 10/1981 | Mitsui | 323/312 X |

*Primary Examiner*—Peter S. Wong

*Attorney, Agent, or Firm*—Blum Kaplan Friedman Silberman & Beran

[57] ABSTRACT

The voltage regulator, entirely of monolithic integrated circuit construction, has an output voltage with a temperature gradient similar to that of the saturation and threshold voltages of liquid crystal elements. Constant current flows through temperature sensitive resistive elements in series with temperature insensitive resistance elements. The output voltage taken across at least a portion of the resistance elements has a voltage/temperature characteristic similar to that of the temperature sensitive elements. Both the level of the output voltage and the temperature gradient of the output voltage are independently controllable and independent of source voltage variations. Buffer circuits may be used between the output of the regulator and load, and sampling techniques are also used to conserve energy by duty cycle operation of higher current circuit elements.

25 Claims, 44 Drawing Figures

FIG. 1a
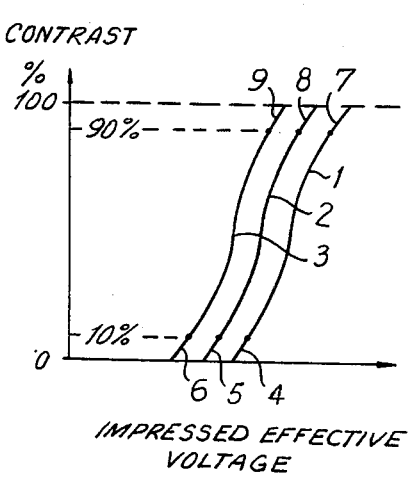
FIG. 1b
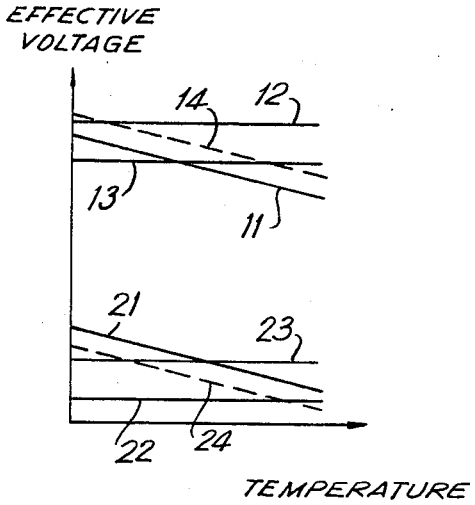
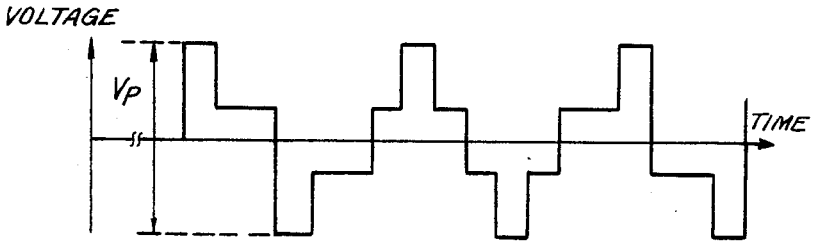
FIG. 1c
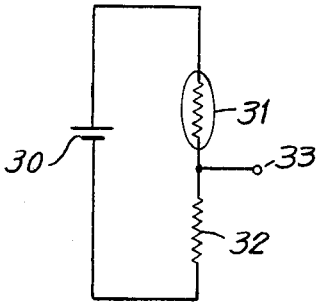
FIG. 2
PRIOR ART FIG. 3
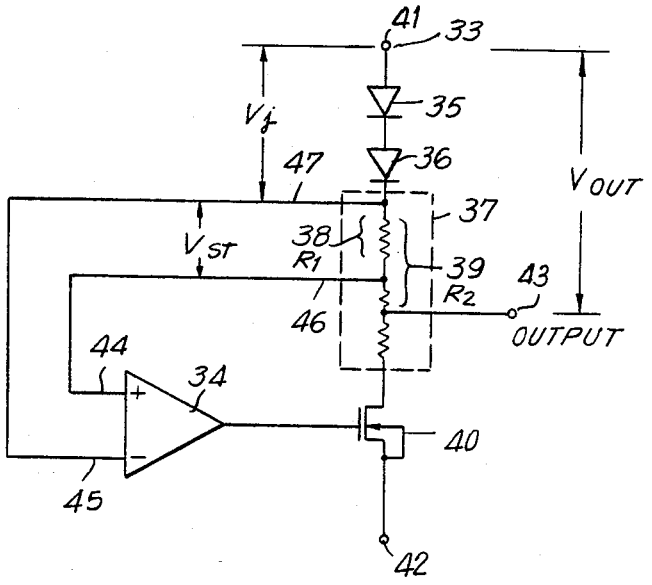
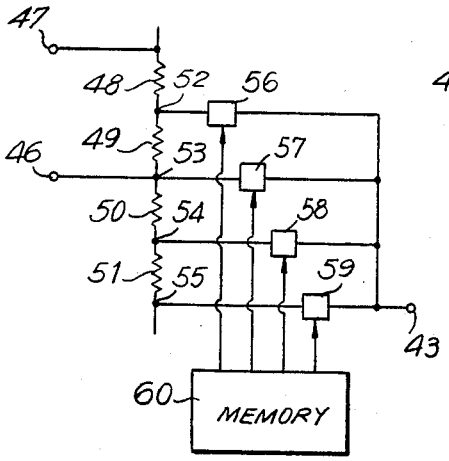
FIG. 4a
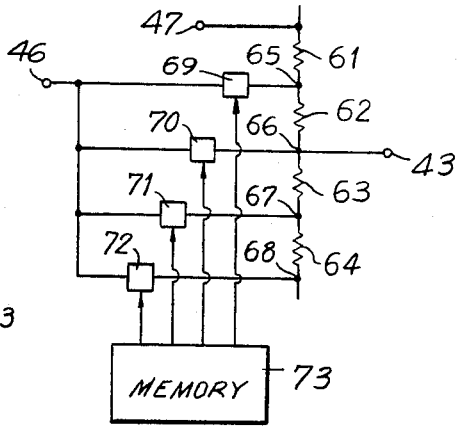
FIG. 4b FIG. 6a
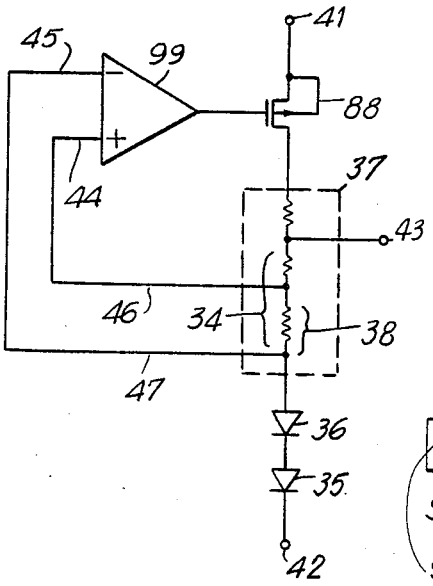
FIG. 6b
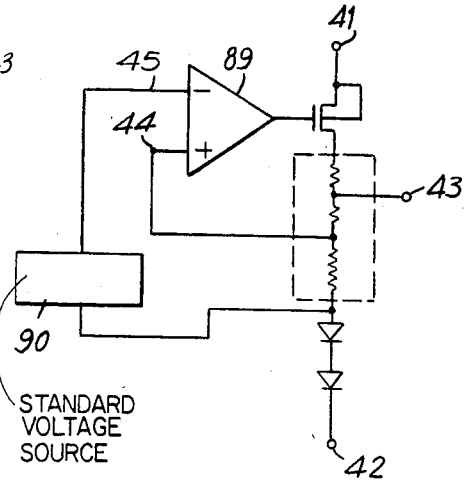
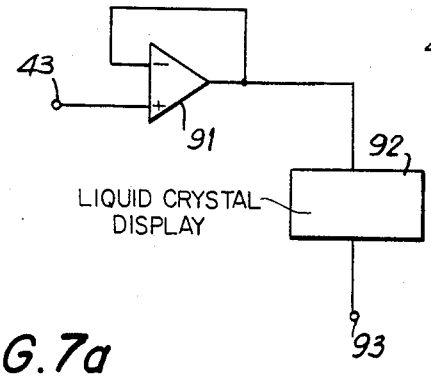
FIG. 7a
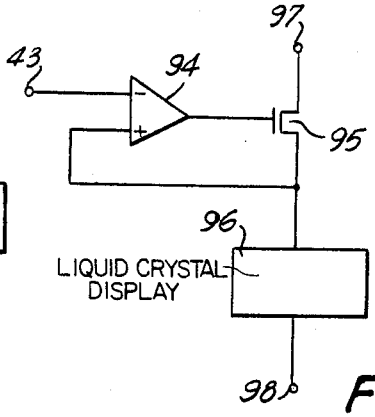
FIG. 7b FIG.9a
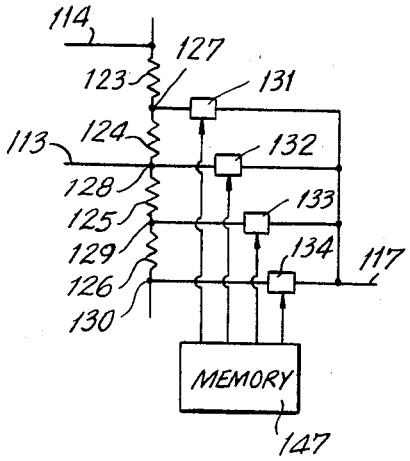
FIG.9b
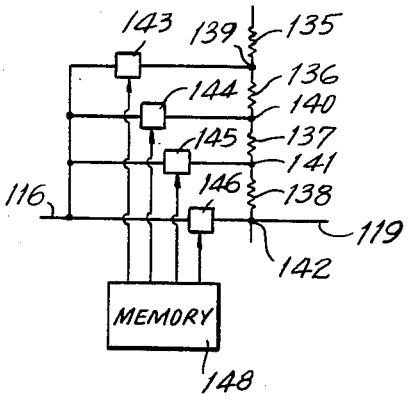
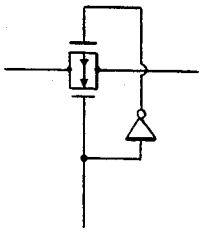
FIG.9c
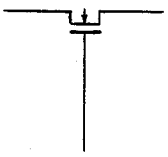
FIG.9d
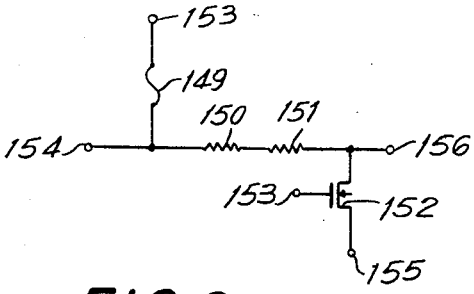
FIG.9e FIG. 12
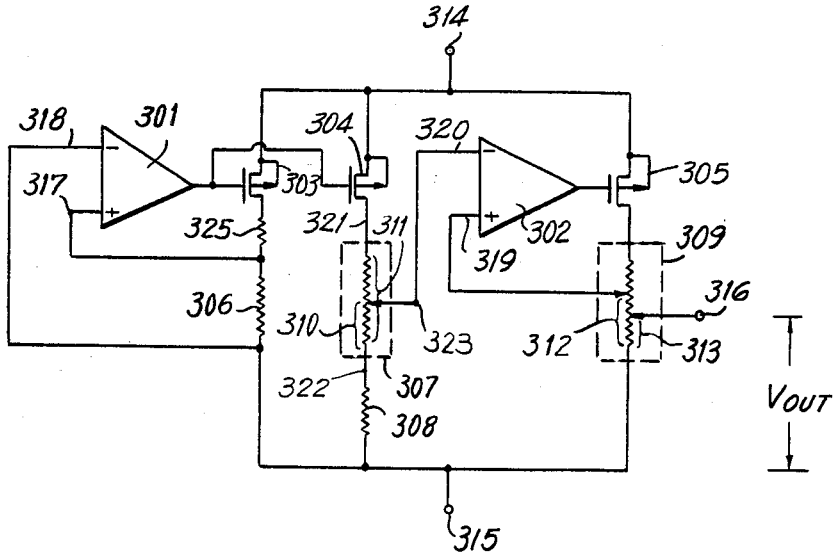
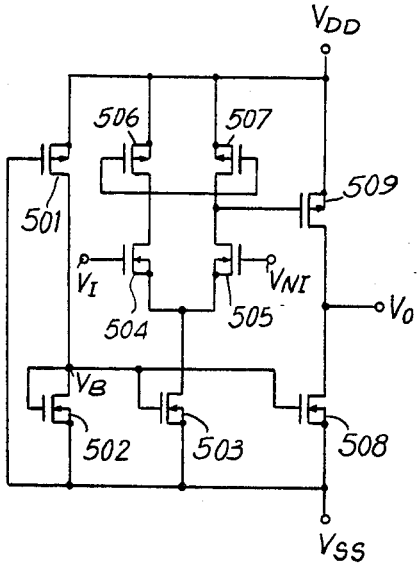
FIG. 14a
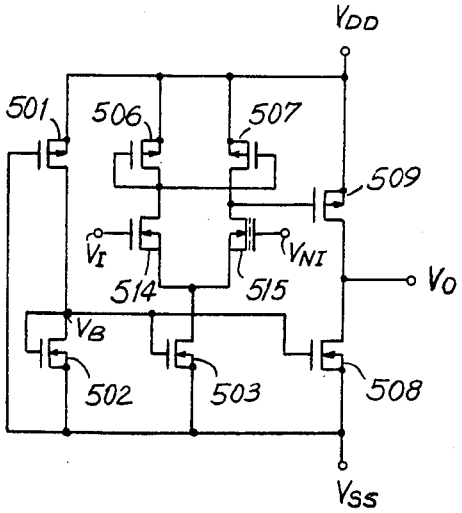
FIG. 14b

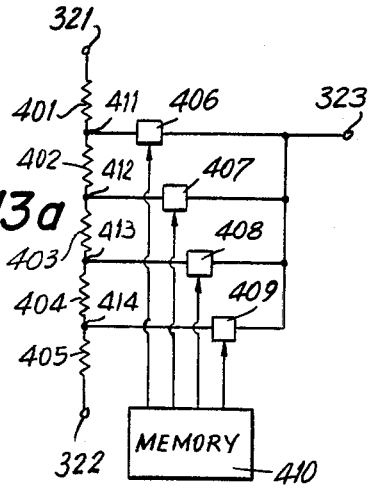
FIG.13a
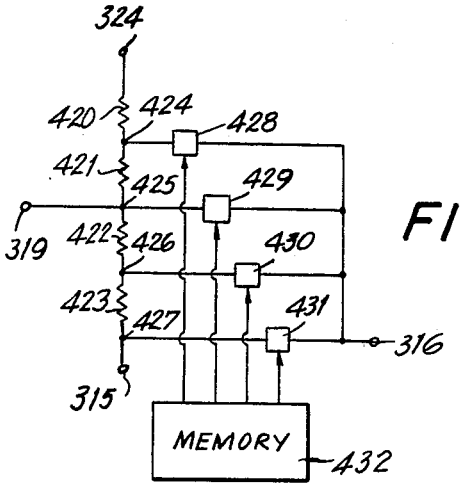
FIG.13b
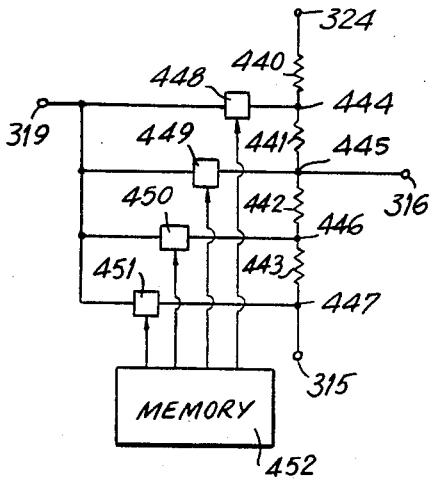
FIG.13c
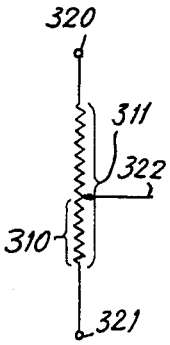
FIG.13d
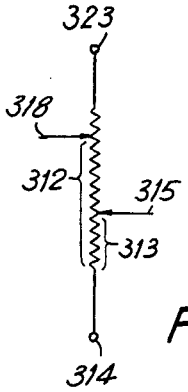
FIG.13e
FIG.13f
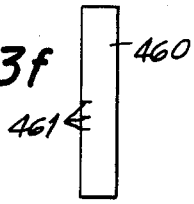
FIG.13g
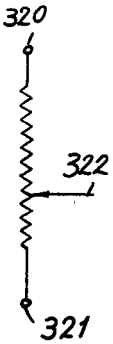
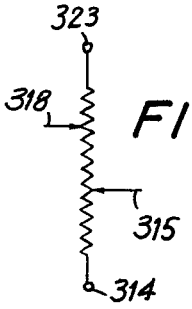
FIG.13h FIG. 15
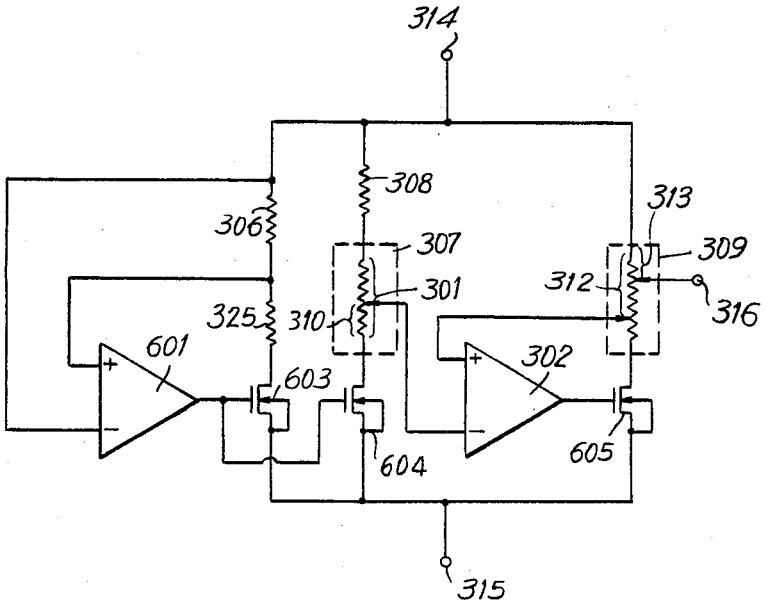
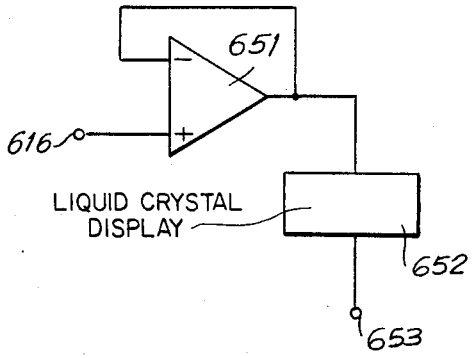
FIG. 16a
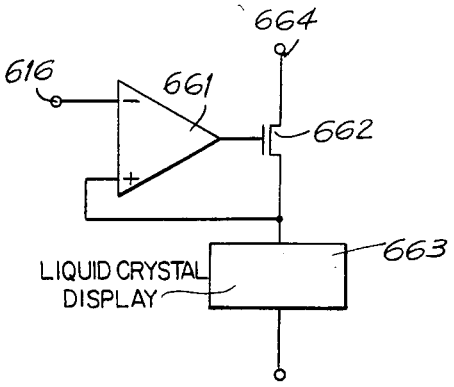
FIG. 16b FIG. 21
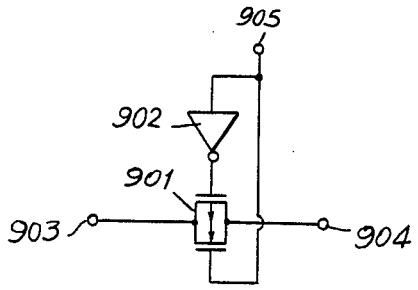
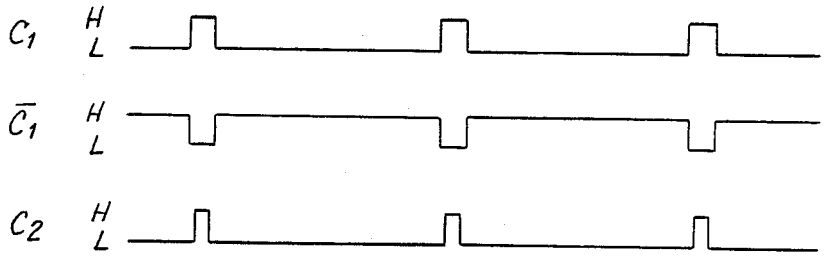
FIG. 22

VOLTAGE REGULATOR FOR LIQUID CRYSTAL DISPLAY

This is a continuation of application Ser. No. 06/217,500, filed Dec. 17, 1980.

BACKGROUND OF THE INVENTION

This invention relates generally to a voltage regulator having an output which drives a liquid crystal display and more particularly to a voltage regulator having an output which compensates for the temperature characteristics of the threshold and saturation voltages of the liquid crystal display elements. An impressed effective voltage which makes a ten percent contrast in the liquid crystal display is considered to be the threshold voltage and an impressed effective voltage which makes a ninety percent contrast on the liquid crystal display is considered as the saturation voltage. At colder temperatures higher effective voltages must be impressed to produce the same contrast. The threshold and saturation voltages have negative temperature coefficients and plot as substantially straight lines. When a liquid crystal is operated by a multiplex time sharing driving method, the impressed effective voltage to make the contrast in the liquid crystal display greater than ninety percent changes in accordance with a duty ratio 1/N, where N is a natural number. The impressed voltage to make the contrast of the display less than ten percent is also varied by the same duty cycle ratio 1/N. When a dot matrix display is used, because the value of N is 7 to 16, or even greater, the ratio of voltage which provides the ninety percent contrast relative to the voltage which provides the ten percent contrast falls as the value of N increases. In such matrix display embodiments, at the low temperature end of the operating range, cross talk is produced in the liquid crystal.

What is needed is a voltage regulator for a liquid crystal display having an output which compensates for the temperature characteristics of the liquid crystal elements and operates without cross talk.

SUMMARY OF THE INVENTION

Generally speaking, in accordance with the invention, a voltage regulator having an output which compensates for the temperature characteristics of the threshold and saturation voltages for a liquid crystal display is proviced. The voltage regulator is entirely of monolithic integrated circuit construction. The output voltage has a temperature gradient similar to that of the saturation and threshold voltages of the liquid crystal elements. Constant current flows through temperature sensitive resistive elements in series with temperature insensitive resistance elements. The output voltage taken across at least a portion of the resistance elements has a voltage/temperature characteristic similar to that of the temperature sensitive elements. Both the level of the output voltage and the temperature gradient of the output voltage are independently controllable. Buffer circuits may be used between the output of the regulator and load, and sampling techniques are also used to conserve energy by duty cycle operation of higher current circuit elements.

Accordingly, it is an object of this invention to provide an improved voltage regulator with temperature compensated output where it is possible to adjust the voltage level of the output voltage and the temperature gradient of the output voltage independently.

Another object of this invention is to provide an improved voltage regulator with temperature compensating characteristics which is produced entirely by monolithic integrated circuit techniques.

A further object of this invention is to provide an improved voltage regulator with temperature compensating characteristics which provides constant voltage levels at fixed temperatures.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1*a* is a graph showing contrast of a liquid crystal display versus impressed effective voltage;

FIG. 1*b* is a graph showing effects of temperature on the driving voltage for a liquid crystal display;

FIG. 1*c* indicates a driving signal for a liquid crystal display;

FIG. 2 is a circuit drawing of a voltage source for a liquid crystal display of the prior art;

FIG. 3 is the circuit of a voltage regulator for liquid crystal display in accordance with the invention;

FIGS. 4*a–e* are alternative embodiments of resistance portions of the circuit of FIG. 3;

FIGS. 6*a, b* are alternative embodiments of voltage regulators in accordance with the invention;

FIGS. 7*a, b* are alternative embodiments of the buffer circuits for use with the voltage regulators in accordance with the invention;

FIGS. 9*a–e* are circuit drawings for adjustable resistance elements for use with the circuit of FIG. 8;

FIG. 12 is an alternative embodiment of a voltage regulator for liquid crystal display in accordance with the invention;

FIGS. 13*a–h* are alternative circuits of adjustable resistance elements for use in the circuit of FIG. 12;

FIGS. 14*a, b* are alternative circuits of operational amplifiers for use in the circuits of FIG. 12;

FIG. 15 is an alternative embodiment of a voltage regulator for liquid crystal display in accordance with the invention;

FIGS. 16*a, b* are alternative circuit embodiments of a buffer for the output of the circuits of FIGS. 12 and 15;

FIG. 21 is a circuit of an analog switch; and

FIG. 22 is waveforms of clock signals for application to the circuits of FIGS. 20*a* and 20*b*.

BRIEF DESCRIPTION OF THE PREFERRED EMBODIMENTS

Figure 4C:
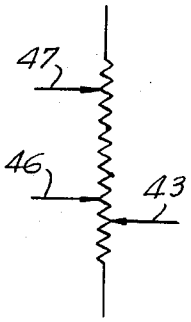

This invention relates to a voltage regulator having an output which compensates for the temperature characteristics of the threshold and saturation voltages for a liquid crystal display. An impressed effective voltage which makes a 10% contrast in the liquid crystal display is called the threshold voltage, hereinafter Vth. An impressed effective voltage which makes a 90% contrast on the liquid crystal display is called the saturation voltage, hereinafter referred to as Vsat. FIG. 1*a* illustrates the effects of temperature changes on the contrast characteristics relative to the impressed effective voltage. In this Figure, characteristic curves 1, 2, 3, respectively, indicate the contrast in the liquid crystal versus the impressed effective voltage at 0°, 20°, and 40° C. As illustrated, at colder temperatures, higher effective voltages must be impressed to produce the same contrast. The threshold voltages Vth 4–6 and saturation voltages Vsat 7–9 are shown respectively for each temperature.

FIG. 1*b* indicates the temperature characteristics of threshold voltage Vth 21 and saturation voltage Vsat 11, respectively. Vth and Vsat have negative temperature coefficients, and plot as substantially straight lines. On the other hand, when a liquid crystal is operated by a multiplex or time sharing driving method, the impressed effective voltage to make the contrast in the liquid crystal display greater than 90%, herein referred to as Von is changed in accordance with a duty ratio 1/N, where N is a natural number. Similarly, the impressed effective voltage to make the contrast in the liquid crystal display less than 10%, hereinafter Voff, is varied by the same duty cycle ratio 1/N. When using a segment display method for the liquid crystal display, because the value of N is in the order of three to four, Von and Voff are as indicated in FIG. 1*b* by the curves 12,22, respectively. Thus, insofar as Von is higher than Vsat and Voff is lower than Vth in the desired temperature range, no cross talk is produced in the liquid display.

However, when a dot matrix display is used for display, because the value of N is 7 to 16 or even more, Von and Voff are respectively as indicated by the curves 13,23 of FIG. 1*b*. In other words, a dynamic margin a=Von/Voff falls as the value of N increases. In such matrix display embodiment, at the lower temperature end of the range, Von is less than Vsat, and at the high end of the temperature range, Voff is higher than Vth. As a result, crosstalk is produced in the liquid crystal.

An object of this invention is to compensate for the deficiency in the display caused by an increase in the value N by providing the impressed effective voltage with a temperature characteristic which corresponds with the temperature characteristics of the liquid crystal.

As best seen in FIG. 1*b*, because Vth and Vsat have temperature characteristics 11,21, respectively, it is possible to prevent crosstalk from arising in a liquid crystal display by providing a condition where Von and Voff have temperature characteristics as indicated by the curves 14,24 in broken lines. In a time sharing driving system, when the duty cycle ratio of the driving voltage is defined as 1/N, and the bias ratio is 1/a, Von and Voff are defined as follows:

$$Von = \frac{VP}{a}\sqrt{\frac{N + a^2 - 1}{N}} \quad (1)$$

$$Voff = \frac{VP}{a}\sqrt{\frac{N + (a-2)^2 - 1}{N}} \quad (2)$$

In each equation, VP indicates peak to peak values of the driving voltage. An example of a multiplex driving voltage wave form, when N=3 and a=3, is illustrated in FIG. 1*c*. As it is the practice to produce the peak to peak voltage VP of the equations (1), (2), by boosting the output voltage V out of a voltage regulator, VP is defined as follows:

$$VP = k\ \mathrm{Vout} \quad (3)$$

In equation (3), K is a natural number. Accordingly, it is necessary to provide the desired output voltage Vout of the voltage regulator with the desired temperature characteristic in order that Von and Voff will have temperature characteristics as indicated by the curves 14,24 in FIG. 1*b*.

A power source circuit (FIG. 2) has been used for liquid cyrstal displays of the prior art. The circuit includes a direct current voltage source 30, a temperature sensitive resistor 31, for example, a thermistor, a resistor 32 and an output terminal 33 for a voltage having variations with temperature of a desired quality. Thus, it is well known to use a temperature sensitive resistor having an extraordinary large temperature coefficient. However, there is a disadvantage in that the temperature sensitive resistor cannot be constructed as part of a monolithic integrated circuit. As a result, manufacturing costs are higher and it is difficult to make the voltage source for a liquid crystal display of a desirably small size. Moreover, it is impossible to adjust the voltage level of the output voltage and the temperature gradient independently in a voltage source as shown in FIG. 2.

A voltage regulator in accordance with the invention, eliminates the above mentioned disadvantages and allows construction of a voltage regulator by monolithic integrated circuit techniques, wherein the output voltage is provided with the desired temperature characteristics. Further, in the voltage regulator in accordance with the invention, it is possible to adjust the voltage level and the temperature gradient independently of each other.

FIG. 3 shows a voltage regulator for liquid crystal display, in accordance with the invention. The regulator includes an operational amplifier 34 having a reference voltage therein, thinfilm PN junction diodes 35,36, for example, polycrystaline silicon diodes, a circuit 37 for adjusting the level of output voltage using a nonvolatile memory element, for example, programmable read only memory comprising a fuse, FAMOS, etc., and an analog switch, for example, a transmission or transfer gate. The circuit 37 may also include in other embodiments an external variable resistor or a thin-filmed resistor which has been trimmed by a laser beam, etc. The voltage regulator circuit of FIG. 3 also includes a N-channel MOSFET 40, a positive voltage source 41, negative voltage source 42, output terminal 43, non-inverted input terminal 44 for the operational amplifier 34, and inverted input terminal 45 of the operational amplifier 34.

The temperature gradient of the output voltage is determined by the temperature characteristics of the PN junction diodes 35,36. The temperature gradient is adjusted by the number of PN junction diodes connected in series. In the circuit of FIG. 3, the number of diodes connected in series is two only as an example. The entire circuit of FIG. 3 including the operational amplifier 34 is constructed as a MOS integrated circuit. The operation amplifier 34 has a constant input offset voltage Vst which is stable against temperature changes. The stable voltage Vst is used as a standard voltage for the voltage regulator circuit.

Figure 5:
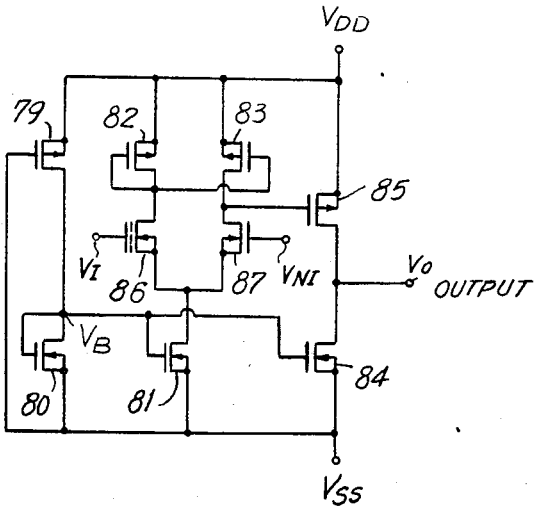
FIG. 5 is an operational amplifier circuit including a standard voltage source.

FIG. 5 illustrates an embodiment of a circuit wherein the operational amplifier 34 is constructed by means of complementary MOS integrated circuitry. In this Figure, a P-channel MOSFET 79 and N-channel MOSFET 80 each constitute a bias circuit. The output VB of the bias circuit is a constant voltage. N-channel MOSFETS 81,86,87 and P-channel MOSFETS 82,83 comprise a differential amplifier stage. VI indicate an inverted input terminal and VNI indicate a non-inverted input terminal for the operational amplifier. In the differential amplifier stage, the threshold voltages of the pair of differential input MOSFETS 86,87 are different from each other. In particular, the threshold voltage of the transistor 86 is higher than the threshold voltage of the transistor 87 by a magnitude Vst. P-channel MOSFETS 82,83 have the same characteristics and are of the same size. N-channel MOSFET 84 and P-channel MOSFET 85 form an output stage which serves for level shifting of the output voltage. The output of this operational amplifier is Vo.

A balance of threshold voltages between such a pair of MOSFETS 86,87 to provide the desired value Vst is accomplished by using certain methods, for example, doping ions having a transfer type opposite to the substrate of a channel of one of the MOSFETS. Another method to achieve Vst is to use different materials for the gates of the pair of MOSFETS or to use a polycrystaline silicon of opposite transfer types for the gates of the pair of MOSFETS 86,87.

The output voltage Vout of the voltage regulator shown in FIG. 3 is defined by an equation (4) presented hereinafter. As indicated by the equation (4), the output voltage Vout is dependent on the standard voltage Vst, but independent of the supply voltage across the terminals 41,42. In other words, the output voltage Vout is stablized by the standard voltage Vst. The input offset voltage Vst is extremely stable under temperature variations and its changes due to aging occur at a very low rate. Thus, Vst, the offset voltage in transistor thresholds is suitable as a standard voltage of a voltage regulator circuit.

The circuit 37 determines the current flowing in the diodes 35,36 connected in series and thereby determines the output voltage produced at a nodal point 43. Assuming that the resistance of the resistor 38 is $R_1$, the resistance of the resistor 39 is $R_2$ and the voltage potential at the terminal 41 with respect to a nodal point 47 is Vj, and the potential of the nodal point 45 with respect to a nodal point 44 is Vst. Thus, the potential of the nodal point 41 with respect to the nodal point 43, that is, the output voltage Vout of the voltage regulator shown in FIG. 3 is defined by the following equation:

$$Vout = V_j + \frac{R_2}{R_1} Vst \quad (4)$$

Because Vst is stable relative to temperature variations, and $R_1$ and $R_2$ have the same temperature coefficient, Vout has a temperature characteristic which is influenced only by the temperature characteristic of $V_j$. The voltage produced in both ends of a PN junction diode has a negative temperature coefficient. When defining the temperature coefficient corresponding to one PN junction diode as $\alpha$ (V/°C.). The temperature coefficient of the voltage Vout, when n diodes are connected in series, is n $\alpha$. In other words, the temperature coefficient of the output voltage is adjusted by the number n of diodes connected in series. On the other hand, in equation (4), voltage level, that is, the voltage level when not considering the variations in temperature, is adjusted by changing the value of $R_2$, $R_1$.

Methods for changing the value of $R_2/R_1$ externally are enumerated as follows. In a first method, the circuit 37 of FIG. 3 is constructed as illustrated in either FIG. 4*a* or 4*b*. Both FIGS. 4*a,b* show embodiments wherein the value of $R_2/R_1$ is initially adjusted by means of a programmable read-only-memory of two bits. The circuits of FIGS. 4*a*,4*b* include connections 43,46,47 which are the same as those in FIG. 3. Also included are integrated resistors 48–51 and 61–64, respectively for the two Figures and integrated analog switches 56–59 and 69–72, respectively. These analog switches are, for example, transmission gates or transfer gates. The circuits also include non-volatile memory elements 60,73, respectively for storing data controlling conduction or non-conduction of each analog switch. The non-volatile memory element is, for example, a programmable read only memory comprising FAMOS, a fuse, etc.

Figure 4D:
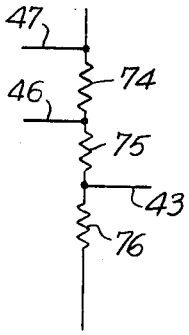
Figure 4E:
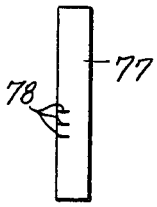

FIG. 4*a* indicates a construction wherein one of the analog switches 56–59 is selectively conductive to change the tapping point of the terminal 43. Thereby, the value of $R_2$ is adjusted. In FIG. 4*b*, the construction is such that one of the analog switches 69–72 is selectively conductive to change the tapping point on the resistors of the terminal 46. Thus, the value of $R_1$ is adjusted depending upon which analog switch 69–72 is conductive. Further, it is possible to adjust the value of $R_2/R_1$ by changing the condition at the terminal 47. In the second method, an external change of the ratio $R_2/R_1$ is accomplished by the following procedure. That is, a part of or the whole of the resistors included in the circuit 37 is mounted outside of the integrated circuit. The external resistor is used as variable resistor. Such an embodiment is shown in FIG. 4*c*. Another method is shown in FIG. 4*d* wherein at least one of the resistors 74 to 76 is a thin-film resistor, for example, a polycrystalline silicon resistor. The value $R_2/R_1$ is adjusted by trimming the thin-film resistor as indicated in FIG. 4*e*. Therein, the resistance is altered externally when the thin-filmed resistor 77 is cut by a laser as indicated with the reference numeral 78.

An alternative embodiment of a voltage regulator circuit in accordance with the invention is shown in FIG. 6*a*. Therein, a positive voltage source is substituted for the negative voltage source of FIG. 3. Also, an operational amplifier 99 incorporates a standard voltage source Vst of opposite polarity to the operational amplifier 34 and a P-channel MOSFET 88 is substituted for the N-channel MOSFET 40.

In another alternative embodiment (FIG. 6*b*) a conventional operational amplifier with an extraordinarily small input offset voltage is substituted for the operational amplifier 34 which incorporates a standard voltage source by utilizing input offset voltages. In FIG. 6*b*, a standard voltage source 90 is separately connected. Further, it is not always necessary to place the PN junction diodes with direct connection to the voltage source as shown in FIGS. 3,6*a,b*. Instead, in alternative embodiments of voltage regulators in accordance with the invention, the PN junction diode or diodes is placed between the resistors, etc.

In the circuits of FIGS. 3,6*a,b*, when connecting a liquid crystal display panel as a load to the output terminal 43, the output voltage varies because of the impedance of the load. Therefore, it is necessary to add an output buffer to the output terminal 43 as shown in FIG. 7*a,b*. These buffers includes respectively operational amplifiers 91,94, the load, that is, the liquid crystal display 92,96, a MOSFET 95 in FIG. 7*b*, for driving the liquid crystal 96 and voltage terminals 93,97,98. The polarity of the MOSFET 95 and the polarity of the voltage terminals 93,97,98 are determined by the construction of the voltage regulator in the preceding stage.

As stated above, the voltage regulator in accordance with the invention compensates the output voltage to correlate with the temperature characteristics of the threshold Vth and the saturation voltage Vsat of the liquid crystal display so as to prevent crosstalk. Further, there is an advantage in that it is possible to adjust the temperature coefficient and the voltage level independently. The voltage regulator can be used with various types of liquid crystals. Moreover, the voltage regulator for a liquid crystal display is readily produced as a monolithic integrated circuit. Power consumption of the voltage regulator is low. There is great utility in using this circuit as a voltage source for a liquid crystal display in a small electronic apparatus such as a digital display, timepiece or an electronic calculator, and the like.

Figure 10:
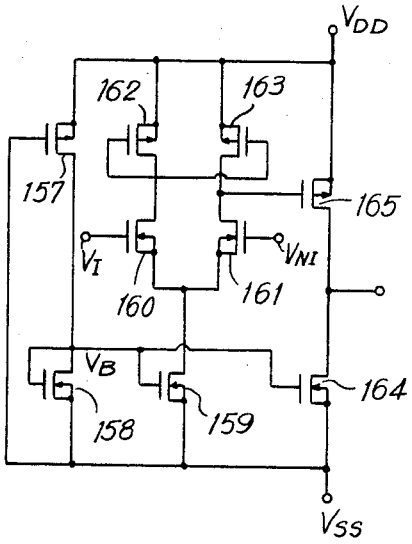
FIG. 10 is the circuit of an operational amplifier for use in the regulator of FIG. 8 when input offset voltage is zero.

An alternative embodiment of a regulator in accordance with the invention is explained with reference to circuit of FIG. 8. The circuit includes an operational amplifier 101 having a reference voltage source therein, and an operational amplifier 102. Constructions of the operational amplifiers 101, 102 are shown in FIGS. 5 and 10. The voltage regulator circuit (FIG. 8) also includes N-channel MOSFETS 103,104, NPN transistor 105 operating as a PN junction diode wherein the base and collector are directly connected together, a positive voltage source 111, a negative voltage source 112, an output terminal 119 and variable resistors 121,122. Construction of the variable resistors is shown in FIG. 9.

Figure 8:
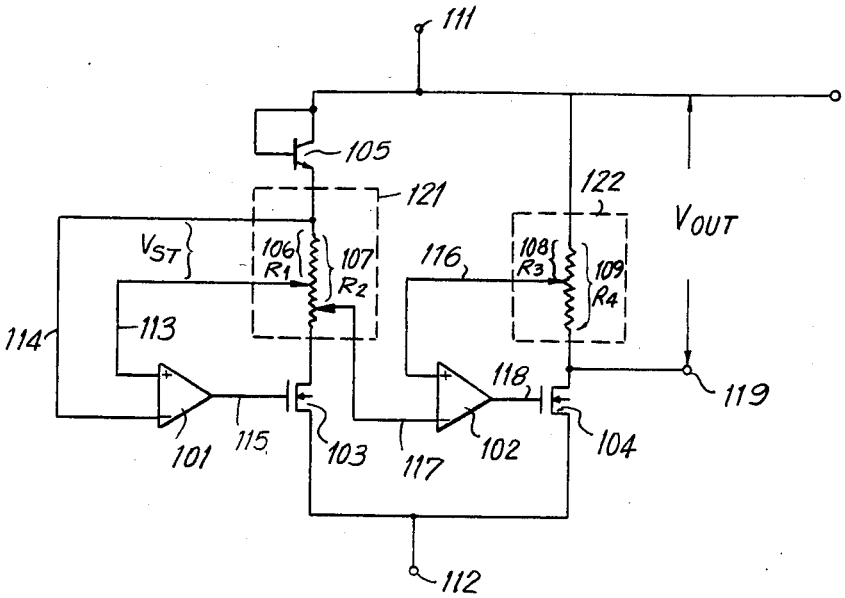
FIG. 8 is another alternative embodiment of a voltage regulator for a liquid crystal display in accordance with the invention.

In FIG. 8, the operational amplifier 101 has a constant input offset voltage Vst, which is not affected by temperature variations. This offset voltage Vst serves as a reference voltage for the voltage regulator. A nodal point 114 has positive potential with respect to a nodal point 113. When the resistance of a resistor 106 is defined as $R_1$, constant current $Vst/R_1$ is supplied to the NPN transistor 105 by the operational amplifier 101 and the N-channel MOSFET 103. The NPN transistor 105 operates as a PN junction diode comprising a base and emitter. Assuming that the forward direction voltage between the base and emitter of the NPN transmitter 105, that is, the voltage of the positive voltage terminal 111 with reference to a nodal point 114, is VBE, and the resistance of a resistor 107 is $R_2$, the voltage potential V of the positive voltage source 111 with reference to a nodal point 117 is as follows:

$$V = \frac{R_2}{R_1} Vst + VBE \tag{5}$$

When defining the resistance of a resistor 108 as $R_3$, and the resistance of a resistor 109 as $R_4$, the potential Vout of the positive voltage source 111 with reference to the output terminal 119 is as follows by operation of the operational amplifier 102 and the N-channel MOSFET 104.

$$Vout = \frac{R_4}{R_3} V = \frac{R_4}{R_3}\left(\frac{R_2}{R_1} Vst + VBE\right) \tag{6}$$

In FIG. 8, Vst is stable relative to temperature variations and a resistor is used for providing the prescribed temperature coefficient by changing the division ratio. The forward direction voltage VBE between the base and the emitter of the diode/transistor 105 has a temperature characteristic approximating −2.3mV/°C. Accordingly, Vout in equation 6 has a temperature characteristic determined only VBE. When Vout versus temperature is plotted as a curve, a linear relationship with a negative slope or inclination is obtained. Assuming that the slope of this straight line, that is, the temperature coefficient, is $\alpha$ and the value of Vout at 25° C. is $\beta$, the equation (2) is modified as a function of temperature t as follows:

$$Vout = \alpha(t-25)+\beta \tag{7}$$

Vout determined from the equation (7) is the output voltage of the voltage regulator circuit of FIG. 8 in accordance with this invention. In the equation (7) it is preferable that the value of and $\beta$ can be changed in accordance with the characteristic of the liquid crystal to be driven, specifically, the temperature characteristics of Vth or Vsat, or in accordance with the driving method. Adjustment of $\alpha$ and $\beta$ can be accomplished by constructing those elements enclosed in broken lines and identified with the reference numerals 121,122 in FIG. 8 as illustrated in FIGS. 9*a* and 9*b*. In FIGS. 9*a,9b*, the circuits include integrated resistors 123–126, 135–138, respectively, analog switches 131–134, and 143–146, for example, transmission gates or transfer gates, etc. The circuits of FIGS. 9*a,b*, also include non-volatile memory devices 147,148, for example, programmable read only memories comprising FAMOS, MNOS, a fuse, etc.

In both FIGS. 9*a* and 9*b*, $\alpha$ and $\beta$ are adjusted by the twobit output of a programmable read only memory 147,148, hereinafter referred to as a PROM. As the first step, data is written into the non-volatile memory device 147 so that only one of the analog switches 131–134 is conductive. In the same manner, the analog switches 143–146 are set in a conducting or non-conducting condition by the data in the non-volatile memory device 148. Only one analog switch 143–146 is conductive.

As for the order of the adjustment of $\alpha$ and $\beta$, $\alpha$ is adjusted first followed by an adjustment of $\beta$. In FIGS. 9*c,9d*, a construction of an analog switch is illustrated. FIG. 9*e* illustrates an exemplary construction of a PROM including a fuse. The circuit of FIG. 9*e* includes a fuse 149 composed of polycrystalline silicon or metal, a polycrystalline silicon resistor 150 required when the fuse 149 is made of polycrystalline silicon, a diffusion resistor or ion implanted resistor 151, N-channel MOSFET 152, positive voltage source 153, terminal 154 for cutting the fuse as required, negative voltage source terminal 155 and output terminal 156 of the PROM.

FIG. 10 illustrates the construction of the operational amplifier 102 (FIG. 8). FIG. 5 illustrates the construction of the operational amplifier 101 having a stable input offset voltage Vst which is used as a reference voltage source. The P and N-channel MOSFETS 157 and 158, respectively shown in FIG. 10 comprise a bias circuit having a constant voltage output VB. The N-channel MOSFETS 159,160,161, and the P-channel MOSFETS 162, 163 comprise a differential amplifier stage. In this construction, the N-channel MOSFETS 160,161 are entirely of the same characteristics and of the same size. Also, the P-channel MOSFETS 162,163 are entirely of the same characteristics and of the same size. VI indicates an inverted input terminal and VNI indicates a non-inverted input terminal. The N-channel MOSFET 164 and the P-channel 165 form an output stage, which provides a level shift of the output voltage. Vo is the output of this operational amplifier.

The circuits of FIGS. 10 and 5 are the same except that in FIG. 5 the MOSFETS 86,87 differ in that the MOSFET 86 has a threshold voltage higher than the threshold voltage of the MOSFET 87. The differences in threshold voltages as described above is Vst.

The output voltage of the voltage regulator of FIG. 8 correlates with the expression of equation (6). As clearly shown by the equation (6), the output voltage Vout is dependent on the standard voltage Vst, but independent of the supply voltage. In other words, the output voltage Vout is stabilized by the standard voltage Vst. The input offset voltage Vst is extremely stable even when temperatures change and the effects of aging on Vst is at a very low rate. Thereby, this offset voltage is suitable as a standard voltage for a voltage regulator.

Figure 11:
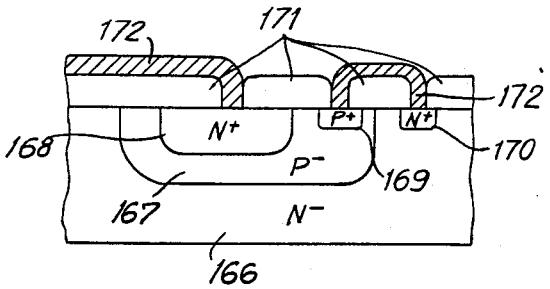
FIG. 11 is a construction of an NPN transistor as used in FIG. 8.

In manufacturing an NPN transistor by MOS integrated circuit techniques, it is conventional that the collector is fixed to a N-substrate, that is, a positive voltage source. Such a construction is illustrated in FIG. 11. Therein the transistor comprises a N−substrate 166, a P−layer 167, N+layers 168,170, an insulated film 171 between layers, a P+layer 169 and conductors 172.

In this sense, the NPN transistor 105 in the circuit of FIG. 8 is constructed such that the collector is fixed to the substrate. Thus, the voltage regulator in accordance with this invention is suitable for manufacturing by MOS integrated circuit techniques.

With regard to the circuit shown in FIG. 8, the same function is performed by substituting a PNP transistor for the NPN transistor 105, substituting a P-channel MOSFET for the N-channel MOSFET 103 or 104, reversing the polarity of Vst of the operational amplifier 101, making the negative voltage source 112 as a positive voltage source and changing the positive voltage source 111 to a negative voltage source.

As an alternative to the above described circuits having a reference voltage produced therein, a reference voltage can be provided from an external reference voltage source instead of including the reference voltage Vst in the operational amplifier 101. Further, there are other methods for adjusting the resistors 121,122 (FIG. 8) and for modifying the adjusting means and using a non-volatile memory device and an analog switch. For example, external resistors can be used and adjusted as a volume control, or a thin-filmed resistor included in the integrated circuit can be adjusted by laser trimming and the like.

As stated above, the voltage regulator in accordance with this invention can be used to prevent crosstalk from arising in a liquid crystal display by compensating for the temperature characteristics of Vth or Vsat. Further, as it is possible to adjust the temperature coefficient and voltage level by using a PROM and an analog switch, the voltage regulator in accordance with the invention can be applied to various types of liquid crystals. Moreover, the manufacturing process for the voltage regulator of this invention coincides well with the manufacturing processes of metal oxides semi-conductors, particularly CMOS, lower power consumption for the circuits can be readily achieved.

FIG. 12 illustrates an alternative embodiment of a voltage regulator for liquid crystal display in accordance with the invention. The circuit includes an operational amplifier 301 including a standard voltage source, operational amplifier 301, P-channel MOSFETS 303–305, resistor 306 being a temperature detector element, a circuit 307 for adjusting temperature gradient, resistor 308 having the same temperature coefficient as that of resistor 306, and a circuit 309 for adjusting the output voltage level. The circuit (FIG. 12) also includes an integrated resistor 325, positive voltage source 314, negative voltage source 315, output terminal 316, non-inverted input terminal 317 of the operational amplifier 301, inverted input terminal 318 of the operational amplifier 301, non-inverted input terminal 319 of the operational amplifier 302, an inverted input terminal 320 of the operational amplifier 302.

A most important feature of this invention is the use of resistors made in the normal manufacturing process of integrated circuits, such as, a diffusion resistor, ion implanted resistor, thin-filmed resistor of polycrystalline silicon, etc. Such an integrated circuit resistor is used in place of a special temperature sensitive resistor, for example, a thermistor. As a result, simplification of the manufacturing processes for a voltage regulator for liquid crystal display is realized as well as a reduction in the manufacturing cost. Miniaturization of the voltage source circuit is also realized.

Construction of the operational amplifiers 301,302 comprising CMOS transistors are shown respectively in FIGS. **14*b* and 14*a*. In FIG. 14*a*, a P-channel MOSFET 501 and a N-channel MOSFET 502 together constitute a bias circuit having a constant voltage VB output. The N-channel MOSFETS 503,504,505 and the P-channel MOSFETS 506,507 comprise a differential amplifier stage. In this embodiment, the N-channel MOSFETS 504,505 are entirely of the same characteristics and of the same size. The P-channel MOSFETS 506,507 are also of the same characteristics and of the same size. The differential amplifier has an inverted input terminal VI and a non-inverted input terminal VNI. The N-channel MOSFET 508 and the P-channel MOSFET 509** form an output stage which provides level shift for the output voltage $V_o$ of the operational amplifier.

The circuits of FIGS. **14*a* and 14*b* are the same except for the pair of differential input MOSFETS 514,515 in FIG. 14*b*. Otherwise the reference numerals in both FIGS. 14*a,b* are the same. The threshold voltage of a MOSFET 514 is higher than the threshold voltage of the MOSFET 515 by a value Vst. In other words, the operational amplifier shown in FIG. 14***b* has offset voltage Vst. The desired difference in threshold voltages between such a pair of MOSFETS is provided by several methods, for example, doping ions whose transfer type is opposite to a substrate to the channel of one of the MOSFETS. Also, the difference can be produced by using different materials for the gates of the transistors in the pair of MOSFETS. Also, the offset can be achieved by using a polycrystalline silicon of opposite transfer type for the respective gates in the MOSFET transistors of the pair.

The output voltage Vout of the voltage regulator illustrated in FIG. 12 is represented by an equation (10) hereinafter. As demonstrated by the equation (10), the output voltage Vout is dependent on the standard voltage Vst, but independent of variations in the supply voltage. In other words, the output voltage Vout is stabilized by the standard voltage Vst. The input offset voltage Vst is extremely stable against temperature variations and its change due to aging occurs at a very low rate. Thus, the offset voltage Vst is suitable as a standard voltage for a voltage regulator.

In FIG. 12, when the resistance of the resistor 306 is defined as $R_1$, the current flowing in the P-channel MOSFET 303, resistors 325, 306 in series is $Vst/R_1$ because the operational amplifier 301 has an input offset voltage Vst. The P-channel transistor 303,304 are entirely of the same characteristic and size, operate in the saturated condition, and the sum of the resistance of the resistors 311,308 is substantially equal to the resistance of the resistor 306. Under such a condition, the value of current flowing in the P-channel MOSFET 304 and resistors 308,311 in series, is accurately $Vst/R_1$. In this construction, where the resistance of the resistors 310,308 is defined respectively as $R_2$ and $R_3$, a potential $V_1$ of a nodal point 323 with respect to the nodal point 315, that is, the negative terminal, is as follows:

$$V_1 = \frac{Vst}{R_1}(R_2 + R_3) \tag{8}$$

Each resistor is formed so that the temperature coefficients of $R_1$ and $R_3$ are equally $\alpha$, and the temperature coefficient $\beta$ of $R_2$ is much small than $\alpha$. Then, the relationship $1>>\alpha>>\beta$ is obtained, and equation 8 is rewritten as follows:

$$V_1 = \frac{Vst}{R_{1o}}[R_{20}(1 - \alpha t) + R_{30}] \tag{9}$$

In equation (9), $\alpha t$ indicates temperature, $R_{10}$, $R_{20}$ and $R_{30}$, respectively indicate the resistance of resistors $R_1$, $R_2$, $R_3$ under the condition where $t=0°$ C. When defining each resistance of the resistors 312,313 as $R_4$, $R_5$, respectively, the potential of the output terminal 316 with respect to the negative voltage source 315, that is, the output voltage Vout of the voltage regulator is represented as follows:

$$Vout = \frac{R_5}{R_4} \cdot \frac{Vst}{R_{10}}[R_{20}(1 - \alpha t) + R_{30})] \tag{10}$$

In equation (10), the temperature coefficients of the resistors 312,313, that is, $R_4$, $R_5$, are equal to each other. From the equation (10), it is shown that the output of the voltage regulator (FIG. 12) has a negative temperature gradient. The temperature gradient of the output voltage of the voltage regulator, and the voltage level can be adjusted individually by changing $R_5/R_4$ by using the adjusting circuit 309 in FIG. 12 and by changing $R_{20}$ by using the adjusting circuit 307 in FIG. 12.

Generally speaking, in an integrated resistor, there is a relationship that the larger is the sheet resistance of a resistor, the greater is the temperature coefficient. On the other hand, it is desirable that a resistor for detecting temperature should have a large temperature coefficient and an adjusting resistor has a small sheet resistance. Considering such a requirement, an example for the combination of resistors required in the circuit of FIG. 12 is that resistors 306, 308 have an impurity concentration which is small, such as a $P^-$ resistor. The resistors within the circuits 307,309 should have an impurity concentration which is large such as a $P^+$ resistor or a polycrystalline silicon resistor.

Constructions for the adjusting circuits 307,309 are as follows. A first construction is shown in FIGS. 13*a*, 13*b* and 13*c*. FIG. 13*a* shows the block 307 and FIGS. 13*b* and 13*c* show the circuit block 309. In each embodiment, a two-bit programmable read-only memory is used. FIGS. 13*a–c* include integrated resistors 401–405, 420–423, 440–443, integrated analog switches, for example, transmission gates, transfer gates, etc. 406–409, 428–431, 448–451, and a non-volatile memory element 410, 432, 452 for storing data representing the conduction or the non-conduction of the integrated analog switches. The non-volatile memory is, for example, a programmable read-only memory comprising FAMOS, or fuses, and the like.

In FIG. 13*a*, one of the analog switches 406–409 is made selectively conductive to adjust the value of $R_2$. In FIG. 13*b*, one of the analog switches 428–431 is made selectively conductive to adjust the value of $R_5$. FIG. 13*c*, one of the analog switches 448–451 is made selectively conductive to adjust the value $R_4$.

A second type of construction for the adjusting circuit blocks 307,309 is illustrated in FIGS. 13*d*, 13*e* and 13*f*. FIGS. 13*d* and 13*e* are respectively constructions of circuit blocks 307 and 309. In the embodiment of FIG. 13*d*, the resistor 310 is formed of a thin film resistor, and the value of $R_2$ is adjusted by trimming the thin film resistor by using a laser, for example, a YAG laser. In FIG. 13*e*, the value of $R_4$ or $R_5$ is also adjusted by laser trimming of a thin film resistor 312 or 313. In FIG. 13*f*, a resistor trimmed by a laser is illustrated. When a thin film resistor 460 is cut by a laser beam as illustrated by the cuts 461, the resistivity is changed by external means.

A third construction type for the circuit blocks 307, 309 is illustrated in FIGS. 13*g* and 13*h*. According to this construction, a portion of or the whole of the resistors included in the adjusting circuits 307, 309 are mounted on the outside of the integrated circuit and this external resistance is of the variable type.

The circuit of FIG. 12 is but an illustrative example of a voltage regulator for liquid crystal display in accordance with the invention. The scope of the invention also includes circuits such as shown in FIG. 15, wherein P-channel MOSFETS 603, 604 and 605 are substituted for the N-channel MOSFETS 303, 304 and 305 of FIG. 12. The operational amplifier 601 including a standard voltage source is of opposite polarity to the operational amplifier 301 of FIG. 12 which also included a standard voltage source.

In another alternative circuit embodiment, a conventional operational amplifier with an extraordinarily small input offset voltage is substituted for the operational amplifier 301 (FIG. 12), which includes a standard voltage source, by utilizing an input offset voltage such as the standard voltage source 90 (FIG. 6b) which is separately mounted. Various circuit constructions serving the same purpose can be conceived, however voltage regulators wherein the output is provided with a temperature characteristic by utilizing the temperature coefficient of an integrated resistor, and the temperature gradient and the voltage level can be individually adjusted, are believed to fall within the scope of the invention.

As stated above, in a voltage regulator for liquid crystal display in accordance with the invention, an output is provided which compensates for the temperature characteristics of Vth and Vsat, and prevents cross-talk in a liquid crystal display. Further, there is an advantage in that it is possible to adjust the temperature coefficient and the voltage level individually. The voltage regulator can be used for various types of liquid crystals. Moreover, a voltage regulator for a liquid crystal is readily accomplished using monolithic integrated circuitry. The voltage regulator is of lower power consumption and therefore has great utility as the voltage source for liquid crystal displays in small-sized electronic apparatuses such as digital display type timepieces or electronic calculators, and the like.

Figure 17:
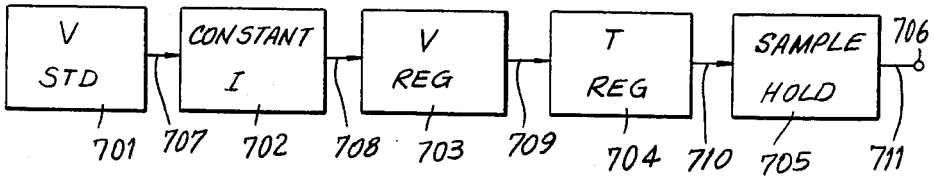
FIG. 17 is a functional block diagram of a voltage regulator in accordance with the invention.

FIG. 17 is a block diagram of an alternative embodiment of a voltage regulator in accordance with this invention. The voltage regulator includes a standard voltage source 701, a constant current source 702, a circuit 703 to output a voltage with a desirable temperature characteristic, the circuit 703 including means for adjusting voltage level. The voltage regulator for liquid crystal display of FIG. 17 also includes a circuit 704 for adjusting a temperature coefficient of the output voltage, a sampling and holding circuit and output buffer 705, and an output terminal 706. Signals are represented by the reference numerals 707–711.

The standard voltage source 701 is provided by either the zener voltage of a zener diode or by the threshold voltage of a metal oxide silicon field effect transistor MOSFET, and the like. The standard voltage 707 outputted by the standard voltage source 701 is converted to constant current 708 by the constant current source 702. The circuit 703 for outputting the voltage with a temperature characteristic, comprises a PN junction in the base and emitter of a bipolar transistor, a PN junction of a diode disposed in a semi-conductor substrate, a PN junction of a thin film transistor or a diode, and an integrated resistor, etc. The voltage regulator circuit 703 may include a circuit for adjusting the voltage level at the output. The temperature regulating circuit 704 adjusts the temperature gradient of the output voltage independent of the voltage level. An operational amplifier or a differential amplifier are necessary as an element of the circuits of FIG. 17.

In accordance with the invention, the activity or non-activity of an operational amplifier or a differential amplifier is controlled by a clock signal $C_1$. As a result of using a clock signal, power consumption is reduced. In the sample/hold circuit 705, after a signal 710 is sampled and held by a clock signal $C_2$, synchronizing the signal $C_1$, driving voltage is output through a buffer circuit for driving a liquid crystal display.

Figure 18:
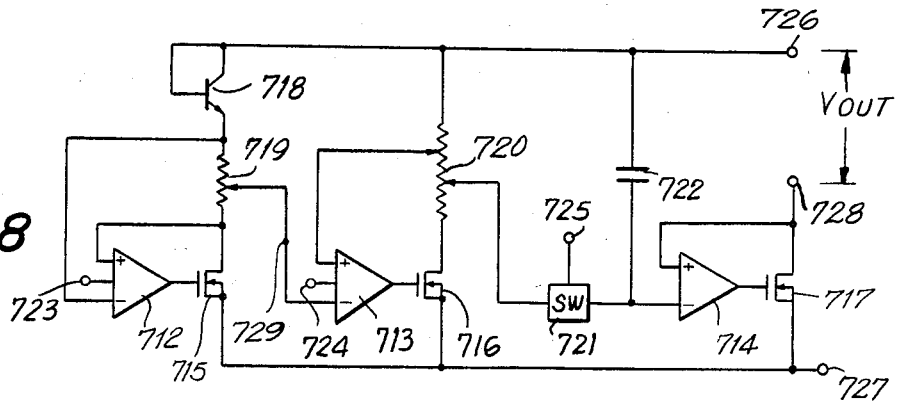
FIGS. 18 and 19 are alternative embodiments of voltage regulators for liquid crystal display in accordance with the invention.
Figure 19:
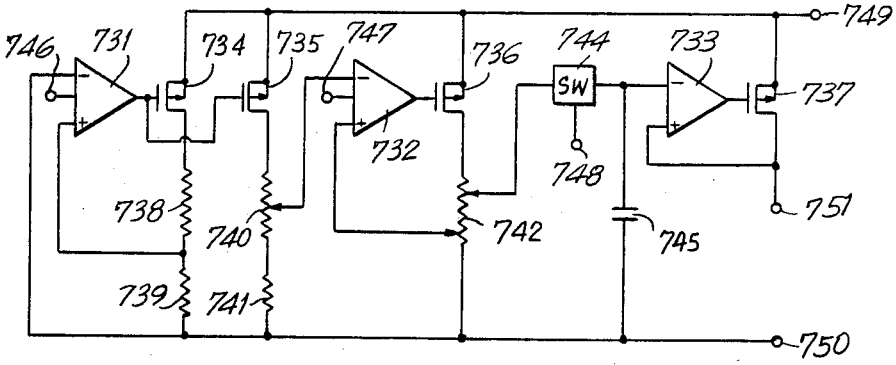

FIGS. 18 and 19 are embodiments of this invention (FIG. 17). The circuit of FIG. 18 includes an operational amplifier 712 incorporating a standard voltage source, clock signal input terminal 723 of the operational amplifier 712, operational amplifiers 713, 714, clock signal input terminal 724 of the operational amplifier 713, N-channel MOSFETS 715–717, NPN transistor 718 wherein the base terminal and collector terminal are directly connected, and integrated resistors 719, 720. The circuit also includes an analog switch 721 whose conduction or non-conduction is controlled by the clock signal input at a terminal 725 of the switch 721. This construction is shown in greater detail in FIG. 21. The circuit also includes capacitors 722, positive voltage source 726, negative voltage source 727 and output terminals 728.

In FIG. 18, a positive sign (+) indicates a non-inverted input terminal and a negative sign (−) indicates an inverted input terminal. Operation of the circuit of FIG. 18 is as follows. Constant current is obtained by means of the standard voltage source incorporated in the operational amplifier 712 and by the resistor 719. A voltage VBE, which has a temperature characteristic with a negative temperature coefficient, is obtained in the forward PN junction portion between the base and emitter of the transistor 718 driven by the above mentioned constant current.

Figure 20A:
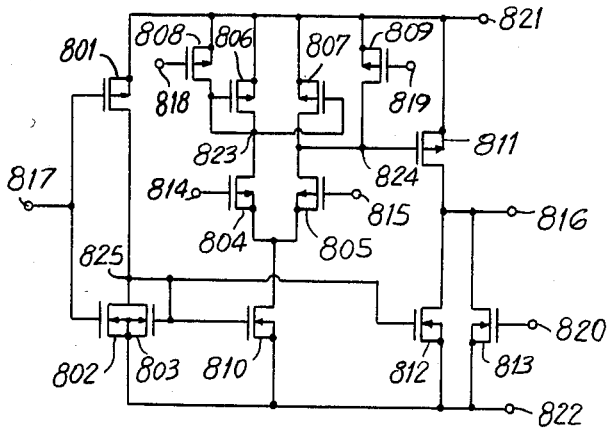
FIGS. 20*a, b* are circuit drawings of alternative embodiments of operational amplifiers for use in the circuits of FIGS. 18 and 19.
Figure 20B:
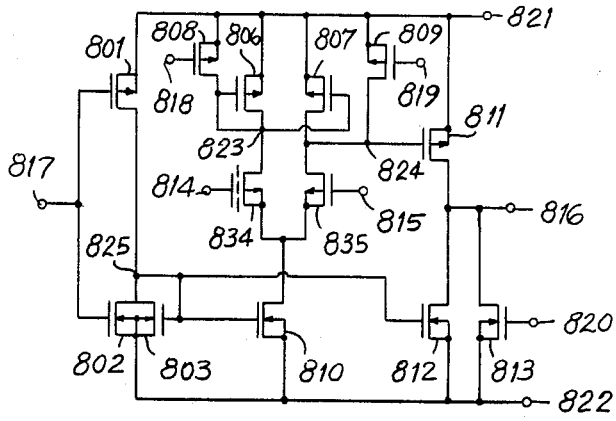

After being adjusted by the resistor 719, whose output point is electrically variable, VBE is input to the inverted input terminal 729 of the operational amplifier 713. A voltage $Vout_1$ which is input to the inverted input terminal 729, is input to the analog switch as $Vout_2$ after being adjusted by the resistor 720 whose output point is also electrically variable. The analog switch 721 and the capacitor 722 form a sampling and holding circuit. After being sampled and held, $Vout_2$ is input to an output buffer circuit comprising the operational amplifier 714 and MOSFET 717. A final driving output is obtained between the output terminal 728 and the positive voltage source 726. In this embodiment, the operational amplifiers 712, 713 are respectively constructed as shown in FIGS. 20b and 20a. The analog switch 721 is constructed as shown in FIG. 21. A clock signal is input to each clock signal input terminal by the following process. According to the following, power consumption of a voltage regulator is substantially reduced.

In FIG. 20a, the P-channel MOSFET 801 and the N-channel MOSFET 802 each constitute a bias circuit having an output VB which is a constant voltage. The N-channel MOSFETS 804, 805, 810 and the P-channel MOSFETS 806, 807 comprise a differential amplifier stage. In this embodiment, the N-channel MOSFETS 804, 805 are entirely of the same characteristics and the same size. The P-channel MOSFETS 806, 807 are also of the same characteristics and of the same size. The circuit has an inverted input terminal 814 and a non-inverted input terminal 815.

The N-channel MOSFET 812 and the P-channel 811 form an output stage, which performs a level shift of the output voltage. The output of this operational amplifier is sensed at the terminal 816. The positive and negative voltage sources are indicated by the reference numerals 821, 822, respectively. P-channel MOSFETS 808, 809 are pull-up transistors for insuring that the potential of each nodal point 823, 824 is high when a signal of low level is input to each clock signal input terminal 818, 819. Similarly, N-channel MOSFETS 802, 813 are pull-down transistors for insuring that the potential of each nodal point 825, 816 is low when a signal of high level is input to each clock signal input terminal 817, 820.

In FIG. 18, operational amplifier 714 is similar to the operational amplifier shown in FIG. 20*a* but the operational amplifier 714 does not incorporate MOSFETS 808, 809, 802 and 813.

The circuits of FIGS. 20*a* and 20*b* are the same except for a pair the differential input MOSFETS 834, 835 in FIG. 20*b*. Other reference numerals in each Figure are the same. MOSFET 834 is a transistor having a threshold which is higher than the threshold voltage of the transistor 835 by a voltage Vst. In other words, the operational amplifier shown in FIG. 20*b* has an offset voltage Vst. The difference of threshold voltage between such a pair of MOSFETS is provided by using some production procedure, such as to dope ions whose transfer type is opposite to the substrate to a channel of one of the MOSFETS, or to use different material in each of the gates of the pair of MOSFETS, or to use a polycrystalline silicon of opposite transfer type in each of the gates of the pair of MOSFETS. Vst is extremely stable, as previously stated, against temperature variations, and changes due to aging occur at a very low rate. Thus, Vst is suitable as a standard voltage source in a voltage regulator for liquid crystal display in accordance with the invention.

In FIG. 21, the circuit includes a transmission gate 901, inverter 902, input terminal 903, output terminal 904, and a clock signal input terminal 905. The circuit of FIG. 21 illustrates only an exemplary embodiment of an analog switch. Other circuits, for example, a monochannel gate, and the like, can also be applied as an analog switch. FIG. 22 illustrates clock signals which are input to clock input terminals of an operational amplifier and analog switch. In FIG. 22, H indicates a high level signal and L indicates a low level signal. Clock signal $C_1$ is applied at terminals 818, 819; signal $\overline{C_1}$ is applied to terminals 817, 820, and clock signal $C_2$ is applied to terminal 905. $\overline{C_1}$ indicates an inverted signal of $C_1$. Clock signal $C_2$ may be the same as clock signal $C_1$, however it is desirable that $C_2$ has a shorter pulse width for duration than that of $C_1$ in order to reduce the possibility of faulty operation of the voltage regulator.

An alternative embodiment of a voltage regulator for liquid crystal display in accordance with the invention is illustrated in FIG. 19. The circuit of FIG. 19 includes an operational amplifier 731 having a standard voltage source therein, clock signal input terminal 746 of the operational amplifier 731, operational amplifiers 732, 733, and a clock signal input terminal 747 of the operational amplifier 732. The circuit also includes P-channel MOSFETS 734–737, integrated resistors 738–742, an analog switch 744 whose conduction or non-conduction is controlled by a clock signal output from the terminal 748, capacitor 745, positive voltage source 749, negative voltage source 750 and output terminal 751.

In the embodiment of FIG. 19, an integrated resistor is used as an element having a temperature characteristic. Resistors in the circuit satisfy the following conditions, that is, the resistors 739 and 741 have equal temperature coefficients $\alpha$ and this $\alpha$ is sufficiently greater than the temperature coefficient $\beta$ of the resistor 741. Further, in the output portion of the operational amplifier, a P-channel transistor is connected between terminals 816, 821 as a pull-up transistor, in place of the pull-down transistor 813 shown in FIGS. 20. Also, clock signal $C_1$ (FIG. 22) is input to the gate. Further, the threshold voltage of the MOSFET 835 is higher than that of the MOSFET 834 by Vst. Otherwise, the circuit is similar to that shown in FIG. 18.

The voltage regulator for liquid crystal display in accordance with the invention, (FIGS. 18,19) compensate for the effects of temperature variation on a liquid crystal display and accomplish this objective using extremely low power because the activity or the non-activity of the operational amplifiers is controlled by a clock signal and then output voltage is obtained by sampling and holding techniques. Further, the voltage regulator for liquid crystal display in accordance with the invention is capable of production monolithically in the same integrated circuit chip used for a timepiece, electric calculator, and the like.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A voltage regulator for driving a liquid crystal display, said display including display elements having threshold and saturation characteristics which vary with temperature, comprising:

a voltage source having a positive and a negative terminal;

first resistance means having a resistance varying with temperature;

second resistance means having a first and a second terminal;

a transistor having a gate, and a source-drain path, said first resistance means, second resistance means and source-drain path of the transistor being coupled in series between the positive and the negative terminals of the voltage source; and an operational amplifier with positive and negative terminals having a stable offset voltage therebetween and an output terminal, the positive and negative terminals of the operational amplifier being coupled to the first and the second terminals of the second resistance means, the output of the operational amplifier being coupled to the gate of the transistor;

whereby the current in the source-drain path of the transistor is equal to the offset voltage divided by the resistance of the second resistance means.

2. The voltage regulator of claim 1 wherein the first resistance means is a bipolar transistor.

3. The voltage regulator of claim 1 wherein the first resistance means is a diode.

4. The voltage regulator of claim 1 wherein the first resistance means is a resistor.

5. The voltage regulator of claim 1 further comprising adjusting means between the second resistance means and the transistor, for adjusting the voltage drop across the first resistance means and the second resistance means.

6. The voltage regulator of claim 1 wherein the offset voltage is produced in the operational amplifier as the difference in threshold voltages of MOSFET's.

7. The voltage regulator of claim 1 wherein all of the components are formed as a monolithic integrated circuit.

8. A voltage regulator for driving a liquid crystal display, said display including display elements having threshold saturation characteristics which vary with temperature comprising:

a voltage source having a positive and a negative terminal;

first resistance means having a resistance varying with temperature;

second resistance means having a first and a second terminal;

a transistor having a gate, and a source-drain path, said first resistance means, second resistance means and source-drain path of the transistor being coupled in series between the positive and the negative terminals of the voltage source;

an operational amplifier with positive and negative terminals and an output terminal; and a standard voltage source, the standard voltage source being coupled between one of the positive and negative terminals of the operational amplifier and one of the first and second terminals of the second resistance means, the other terminal of the positive and the negative of the operational amplifier being coupled to the other terminal of the second resistance means, the output of the operational amplifier being coupled to the gate of the transistor; whereby the current in the source-drain path of the transistor is equal to the voltage of the standard voltage source divided by the resistance of the second resistance means.

9. The voltage regulator of claim 8 wherein the first resistance means is a bipolar transistor.

10. The voltage regulator of claim 8 wherein the first resistance means is a diode.

11. The voltage regulator of claim 8 wherein the first resistance means is a resistor.

12. The voltage regulator of claim 8 further comprising adjusting means between the second resistance means and the transistor for adjusting the voltage drop across the first resistance means and the second resistance means.

13. The voltage regulator of claim 8 wherein all of the components are formed as a monolithic integrated circuit.

14. The voltage regulator of claim 1 further comprising third and fourth resistance means each having first and second terminals; a second transistor having a gate and a source-drain path; and a second operational amplifier with a positive and a negative input terminal and an output terminal, the first terminal of the third resistance means being electrically coupled to one of the terminals of the voltage source, said third resistance means, fourth resistance means and source-drain path of said second tranistor being coupled in series between the positive and negative terminals of said voltage source, the positive terminal of said operational amplifier being coupled to said second terminal of said third resistance means, said negative terminal of said second operational amplifier being coupled to a point between said second resistance means and said transistor, the output terminal of the second operational amplifier being coupled to the base of said second transistor, the voltage between said positive terminal of said voltage source and a point between the fourth resistance means and the source-drain path of said second transistor being an output voltage.

15. The voltage regulator of claim 14 wherein the output voltage varies inversely with temperature.

16. The voltage regulator of claim 15 wherein the ratio of the magnitudes of the resistances of the fourth and third resistance means determines the sensitivity of the output voltage to changes in temperature.

17. The voltage regulator of claim 14 wherein the adjustment means includes an adjustment resistor.

18. The voltage regulator of claim 17 wherein the ratio of the magnitudes of the resistances of the second resistance means and the adjustment resistor determines the magnitude of the output voltage at a given temperature.

19. The voltage regulator of claim 18 wherein the output voltage varies inversely with temperature.

20. The voltage regulator of claim 19 wherein the ratio of the magnitudes of the resistances of the fourth and third resistance means determines the sensitivity of the output voltage to changes in temperature.

21. The voltage regulator of claim 1 wherein the voltage across the first and second resistance means is an output voltage.

22. The voltage regulator of claim 21 further comprising temperature sensitivity varying means coupled to the output voltage for varying the gradient of the output voltage as temperatures vary and producing a temperature varying output voltage.

23. The voltage regulator of claim 22 wherein the temperature sensitivity varying means includes a potentiometer.

24. The voltage regulator of claim 22 further comprising magnitude varying means coupled to the temperature varying output voltage for varying the magnitude of the temperature varying output voltage and producing a temperature and magnitude varying output voltage.

25. The voltage regulator of claim 24 wherein the magnitude varying means includes a potentiometer.

* * * * *